US008950517B2

(12) United States Patent
Hall et al.

(10) Patent No.: US 8,950,517 B2
(45) **Date of Patent: *Feb. 10, 2015**

(54) DRILL BIT WITH A RETAINED JACK ELEMENT

(75) Inventors: David R. Hall, Provo, UT (US); Francis Leany, Salem, UT (US); Joe Fox, Spanish Fork, UT (US); Tyson J. Wilde, Spanish Fork, UT (US); Boyd Black, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 2 days.

This patent is subject to a terminal disclaimer.

(21) Appl. No.: 12/824,199

(22) Filed: Jun. 27, 2010

(65) Prior Publication Data

US 2011/0048811 A1 Mar. 3, 2011

Related U.S. Application Data

(60) Division of application No. 11/774,647, filed on Jul. 9, 2007, now Pat. No. 7,753,144, which is a continuation-in-part of application No. 11/759,992, filed on Jun. 8, 2007, now Pat. No. 8,130,117, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of (Continued)

(51) Int. Cl.

| | |
|---|---|
| ***E21B 10/36*** | (2006.01) |
| ***E21B 7/06*** | (2006.01) |
| ***E21B 4/14*** | (2006.01) |
| ***E21B 10/26*** | (2006.01) |
| ***E21B 10/54*** | (2006.01) |
| ***E21B 10/58*** | (2006.01) |
| ***E21B 10/62*** | (2006.01) |
| ***E21B 47/12*** | (2012.01) |

(52) U.S. Cl.

CPC ... *E21B 7/06* (2013.01); *E21B 4/14* (2013.01); *E21B 7/064* (2013.01); *E21B 7/065* (2013.01); *E21B 10/26* (2013.01); *E21B 10/54* (2013.01); *E21B 10/58* (2013.01); *E21B 10/62* (2013.01); *E21B 47/122* (2013.01)

USPC ..... 175/420.1; 175/385; 175/426; 175/432

(58) Field of Classification Search

USPC ..... 175/420.1, 426, 432, 385

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kuhne |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | August |
| 1,372,257 | A | 3/1921 | Swisher |

(Continued)

OTHER PUBLICATIONS

International Search Report for PCT/US06/43125, mailed Feb. 23, 2007.

(Continued)

*Primary Examiner* — David Andrews
*Assistant Examiner* — Taras P Bemko
(74) *Attorney, Agent, or Firm* — Osha Liang LLP

(57) ABSTRACT

A drill bit having a bit body intermediate a shank and a working face having at least one cutting insert. A bore is formed in the working face co-axial within an axis of rotation of the drill bit. A jack element is retained within the bore by a retaining element that intrudes a diameter of the bore.

15 Claims, 10 Drawing Sheets

Related U.S. Application Data application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, said application No. 11/774,647 is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(56) References Cited

U.S. PATENT DOCUMENTS

| | | | |
|---|---|---|---|
| 1,387,733 | A | 8/1921 | Midgett |
| 1,460,671 | A | 7/1923 | Wilhelm |
| 1,544,757 | A | 7/1925 | Hufford |
| 1,746,455 | A | 2/1930 | Woodruff |
| 1,821,474 | A | 9/1931 | Mercer |
| 1,836,638 | A | 12/1931 | Bonney |
| 1,879,177 | A | 9/1932 | Gault |
| 2,022,101 | A | 11/1935 | Wright |
| 2,054,255 | A | 9/1936 | Howard |
| 2,064,255 | A | 12/1936 | Garfield |
| 2,169,223 | A | 8/1939 | Christian |
| 2,196,940 | A | 4/1940 | Potts |
| 2,199,692 | A | 5/1940 | Catland |
| 2,218,130 | A | 10/1940 | Frederick |
| 2,227,233 | A | 12/1940 | Scott et al. |
| 2,300,016 | A | 10/1942 | Scott et al. |
| 2,320,136 | A | 5/1943 | Kammerer |
| 2,345,024 | A | 3/1944 | Bannister |
| 2,375,335 | A | 5/1945 | Walker |
| 2,466,991 | A | 4/1949 | Kammerer |
| 2,540,464 | A | 2/1951 | Stokes |
| 2,545,036 | A | 3/1951 | Kammerer |
| 2,575,173 | A | 11/1951 | Johnson |
| 2,619,325 | A | 11/1952 | Arutunoff |
| 2,626,780 | A | 1/1953 | Ortloff |
| 2,643,860 | A | 6/1953 | Koch |
| 2,725,215 | A | 11/1955 | Macneir |
| 2,746,721 | A | 5/1956 | Moore |
| 2,776,819 | A | 1/1957 | Brown |
| 2,807,443 | A | 9/1957 | Wyman |
| 2,815,932 | A | 12/1957 | Wolfram |
| 2,819,041 | A | 1/1958 | Beckham |
| 2,819,043 | A | 1/1958 | Henderson |
| 2,838,284 | A | 6/1958 | Austin |
| 2,873,093 | A | 2/1959 | Hildebrandt |
| 2,877,984 | A | 3/1959 | Causey |
| 2,894,722 | A | 7/1959 | Buttolph |
| 2,901,223 | A | 8/1959 | Scott |
| 2,942,850 | A | 6/1960 | Heath |
| 2,942,851 | A | 6/1960 | Beck |
| 2,963,102 | A | 12/1960 | Smith |
| 2,998,085 | A | 8/1961 | Dulaney |
| 3,055,443 | A | 9/1962 | Edwards |
| 3,058,532 | A | 10/1962 | Lee |
| 3,059,708 | A | 10/1962 | Cannon et al. |
| 3,075,592 | A | 1/1963 | Overly et al. |
| 3,077,936 | A | 2/1963 | Arutunoff |
| 3,135,341 | A | 6/1964 | Ritter |
| 3,139,147 | A | 6/1964 | Hays |
| 3,199,617 | A | 8/1965 | White |
| 3,294,186 | A | 12/1966 | Buell |
| 3,301,339 | A | 1/1967 | Pennebaker, Jr. |
| 3,346,060 | A | 10/1967 | Beyer |
| 3,379,264 | A | 4/1968 | Cox |
| 3,387,673 | A | 6/1968 | Thompson |
| 3,429,390 | A | 2/1969 | Bennett |
| 3,433,331 | A | 3/1969 | Heyberger |
| 3,455,158 | A | 7/1969 | Richter, Jr. et al. |
| 3,493,165 | A | 2/1970 | Schonfeld |
| 3,583,504 | A | 6/1971 | Aalund |
| 3,635,296 | A | 1/1972 | Lebourg |
| 3,667,556 | A | 6/1972 | Henderson |
| 3,688,852 | A | 9/1972 | Gaylord et al. |
| 3,765,493 | A | 10/1973 | Rosar et al. |
| 3,807,512 | A | 4/1974 | Pogonowski |
| 3,815,692 | A | 6/1974 | Varley |
| 3,821,993 | A | 7/1974 | Kniff et al. |
| 3,885,638 | A | 5/1975 | Skidmore et al. |
| 3,955,635 | A | 5/1976 | Skidmore |
| 3,960,223 | A | 6/1976 | Kleine |
| 3,989,114 | A | 11/1976 | Tschirky |
| 4,081,042 | A | 3/1978 | Johnson |
| 4,096,917 | A | 6/1978 | Harris |
| 4,106,577 | A | 8/1978 | Summers |
| 4,165,790 | A | 8/1979 | Emmerich |
| 4,176,723 | A | 12/1979 | Arceneaux |
| 4,186,628 | A | 2/1980 | Bonnice |
| 4,207,964 | A | 6/1980 | Taguchi |
| 4,253,533 | A | 3/1981 | Baker |
| 4,262,758 | A | 4/1981 | Evans |
| 4,280,573 | A | 7/1981 | Sudnishnikov et al. |
| 4,304,312 | A | 12/1981 | Larsson |
| 4,307,786 | A | 12/1981 | Evans |
| 4,386,669 | A | 6/1983 | Evans |
| 4,397,361 | A | 8/1983 | Langford |
| 4,416,339 | A | 11/1983 | Baker |
| 4,445,580 | A | 5/1984 | Sahley |
| 4,448,269 | A | 5/1984 | Ishikawa et al. |
| 4,478,296 | A | 10/1984 | Richman |
| 4,499,795 | A | 2/1985 | Radtke |
| 4,531,592 | A | 7/1985 | Hayatdavoudi |
| 4,535,853 | A | 8/1985 | Ippolito et al. |
| 4,538,691 | A | 9/1985 | Dennis |
| 4,566,545 | A | 1/1986 | Story et al. |
| 4,574,895 | A | 3/1986 | Dolezal |
| 4,583,592 | A | 4/1986 | Gazda et al. |
| 4,597,454 | A | 7/1986 | Schoeffler |
| 4,612,987 | A | 9/1986 | Cheek |
| 4,615,399 | A | 10/1986 | Schoeffler |
| 4,624,306 | A | 11/1986 | Traver et al. |
| 4,637,479 | A | 1/1987 | Leising |
| 4,640,374 | A | 2/1987 | Dennis |
| 4,679,637 | A | 7/1987 | Cherrington et al. |
| 4,683,781 | A | 8/1987 | Kar et al. |
| 4,694,913 | A | 9/1987 | McDonald et al. |
| 4,732,226 | A | 3/1988 | Ebeling et al. |
| 4,733,734 | A | 3/1988 | Bardin |
| 4,775,017 | A | 10/1988 | Forrest et al. |
| 4,817,739 | A | 4/1989 | Jeter |
| 4,821,819 | A | 4/1989 | Whysong |
| 4,836,301 | A | 6/1989 | Van Dongen et al. |
| 4,852,672 | A | 8/1989 | Behrens |
| 4,858,706 | A | 8/1989 | Lebourgh |
| 4,875,531 | A | 10/1989 | Biehl et al. |
| 4,889,017 | A | 12/1989 | Fuller et al. |
| 4,907,665 | A | 3/1990 | Kar et al. |
| 4,938,297 | A | 7/1990 | Schmidt |
| 4,962,822 | A | 10/1990 | Pascale |
| 4,974,688 | A | 12/1990 | Helton |
| 4,979,577 | A | 12/1990 | Walter |
| 4,981,184 | A | 1/1991 | Knowlton et al. |
| 4,991,670 | A | 2/1991 | Fuller |
| 5,009,273 | A | 4/1991 | Grabinski |

(56) References Cited

U.S. PATENT DOCUMENTS 5,027,914 A 7/1991 Wilson
5,038,873 A 8/1991 Jurgens
5,088,568 A 2/1992 Simuni
5,094,304 A 3/1992 Briggs
5,103,919 A 4/1992 Warren et al.
5,119,892 A 6/1992 Clegg et al.
5,135,060 A 8/1992 Ide
5,141,063 A 8/1992 Quesenbury
5,148,875 A 9/1992 Karlsson et al.
5,176,212 A 1/1993 Tandberg
5,186,268 A 2/1993 Clegg
5,193,628 A 3/1993 Hill et al.
5,222,566 A 6/1993 Taylor et al.
5,255,749 A 10/1993 Bumpurs et al.
5,259,469 A 11/1993 Stjernstrom et al.
5,265,682 A 11/1993 Russell et al.
5,311,953 A 5/1994 Walker
5,361,859 A 11/1994 Tibbitts
5,388,649 A 2/1995 Ilomaki
5,410,303 A 4/1995 Comeau et al.
5,417,292 A 5/1995 Polakoff
5,423,389 A 6/1995 Warren
5,443,128 A 8/1995 Amaudric du Chaffaut
5,475,309 A 12/1995 Hong
5,507,357 A 4/1996 Hult
5,553,678 A 9/1996 Barr et al.
5,560,440 A 10/1996 Tibbitts
5,568,838 A 10/1996 Struthers
5,655,614 A 8/1997 Azar
5,678,644 A 10/1997 Fielder
5,720,355 A 2/1998 Lamine et al.
5,732,784 A 3/1998 Nelson
5,758,732 A 6/1998 Liw
5,778,991 A 7/1998 Runquist et al.
5,794,728 A 8/1998 Palmberg
5,833,021 A 11/1998 Mensa-Wilmot et al.
5,896,938 A 4/1999 Moeny et al.
5,901,113 A 5/1999 Masak
5,904,444 A 5/1999 Kabeuchi et al.
5,906,245 A * 5/1999 Tibbitts et al. ..... 175/426
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott et al.
5,992,547 A 11/1999 Caraway et al.
5,992,548 A 11/1999 Silva et al.
6,021,589 A 2/2000 Cagliari et al.
6,039,131 A 3/2000 Beaton
6,047,239 A 4/2000 Berger et al.
6,050,350 A 4/2000 Morris et al.
6,131,675 A 10/2000 Anderson
6,150,822 A 11/2000 Hong et al.
6,161,631 A 12/2000 Kennedy et al.
6,186,251 B1 2/2001 Butcher
6,202,761 B1 3/2001 Forney
6,213,225 B1 4/2001 Chen
6,213,226 B1 4/2001 Eppink et al.
6,223,824 B1 5/2001 Moyes
6,269,893 B1 8/2001 Beaton et al.
6,296,069 B1 10/2001 Lamine et al.
6,321,858 B1 11/2001 Wentworth et al.
6,340,064 B2 1/2002 Fielder et al.
6,364,034 B1 4/2002 Schoeffler
6,364,038 B1 4/2002 Driver
6,394,200 B1 5/2002 Watson et al.
6,439,326 B1 8/2002 Huang et al.
6,450,269 B1 9/2002 Wentworth et al.
6,454,030 B1 9/2002 Findley et al.
6,467,341 B1 10/2002 Boucher et al.
6,474,425 B1 11/2002 Truax et al.
6,484,819 B1 11/2002 Harrison
6,484,825 B2 11/2002 Watson et al.
6,510,906 B1 1/2003 Richert et al.
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey et al.
6,652,202 B2 11/2003 Remke
6,668,949 B1 12/2003 Rives
6,698,537 B2 3/2004 Pascale
6,729,420 B2 5/2004 Mensa-Wilmot
6,732,817 B2 5/2004 Dewey et al.
6,789,635 B2 9/2004 Wentworth et al.
6,822,579 B2 11/2004 Goswami et al.
6,929,076 B2 8/2005 Fanuel et al.
6,948,572 B2 9/2005 Hay et al.
6,953,096 B2 10/2005 Gledhill et al.
7,096,980 B2 8/2006 Trevas
7,104,344 B2 9/2006 Kriesels
7,198,119 B1 4/2007 Hall et al.
7,207,398 B2 4/2007 Runia et al.
7,225,886 B1 6/2007 Hall
7,240,744 B1 7/2007 Kemick
7,258,179 B2 8/2007 Hall
7,270,196 B2 9/2007 Hall
7,337,858 B2 3/2008 Hall et al.
7,360,610 B2 4/2008 Hall et al.
7,398,837 B2 7/2008 Hall et al.
7,419,018 B2 9/2008 Hall et al.
7,426,968 B2 9/2008 Hall et al.
7,497,279 B2 3/2009 Hall et al.
7,506,701 B2 3/2009 Hall et al.
7,506,706 B2 * 3/2009 Hall et al. ..... 175/385
7,533,737 B2 5/2009 Hall et al.
7,571,780 B2 8/2009 Hall et al.
7,617,886 B2 11/2009 Hall
7,641,002 B2 1/2010 Hall et al.
7,661,487 B2 2/2010 Hall et al.
7,694,756 B2 4/2010 Hall et al.
2003/0213621 A1 11/2003 Britten
2004/0238221 A1 * 12/2004 Runia et al. ..... 175/61
2007/0114067 A1 5/2007 Hall
2007/0114068 A1 5/2007 Hall et al.
2007/0119630 A1 5/2007 Hall et al.

OTHER PUBLICATIONS

Written Opinion for PCT/US06/43125, mailed Jun. 4, 2007.
International Report on Patentability, Chapter I, for PCT/US07/43125, mailed May 27, 2008.
International Search Report for PCT/US07/64539, mailed Jun. 16, 2008.
Written Opinion for PCT/US07/64539, mailed Jun. 16, 2008.
International Report on Patentability, Chapter I, for PCT/US07/64539, mailed Jun. 16, 2008.
International Search Report for PCT/US07/64544, mailed Aug. 5, 2008.
Written Opinion for PCT/US07/64544, mailed Jun. 16, 2008.
International Report on Patentability, Chapter 1, for PCT/US07/64544, mailed Aug. 8, 2008.

* cited by examiner

DRILL BIT WITH A RETAINED JACK ELEMENT

CROSS REFERENCE TO RELATED APPLICATIONS

This Patent Application is a divisional of U.S. patent application Ser. No. 11/774,647 filed on Jul. 9, 2007 and now U.S. Pat. No. 7,753,144. U.S. patent application Ser. No. 11/774,647 is a continuation-in-part of U.S. patent application Ser. No. 11/759,992 filed on Jun. 8, 2007 and now U.S. Pat. No. 8,130,117. U.S. patent application Ser. No. 11/759,922 is a continuation-in-part of U.S. patent application Ser. No. 11/750,700 filed on May 18, 2007 and now U.S. Pat. No. 7,549,489. U.S. patent application Ser. No. 11/750,700 a continuation-in-part of U.S. patent application Ser. No. 11/737,034 filed on Apr. 18, 2007 and now U.S. Pat. No. 7,503,405. U.S. patent application Ser. No. 11/737,034 is a continuation-in-part of U.S. patent application Ser. No. 11/686,638 filed on Mar. 15, 2007 and now U.S. Pat. No. 7,424,922. U.S. patent application Ser. No. 11/686,638 is a continuation-in-part of U.S. patent application Ser. No. 11/680,997 filed on Mar. 1, 2007 and now U.S. Pat. No. 7,419,016. U.S. patent application Ser. No. 11/680,997 is a continuation-in-part of U.S. patent application Ser. No. 11/673,872 filed on Feb. 12, 2007 and now U.S. Pat. No. 7,484,576. U.S. patent application Ser. No. 11/673,872 is a continuation-in-part of U.S. patent application Ser. No. 11/611,310 filed on Dec. 15, 2006 and now U.S. Pat. No. 7,600,586. U.S. patent application Ser. No. 11/774,647 is also a continuation-in-part of U.S. patent application Ser. No. 11/278,935 filed on Apr. 6, 2006 and now U.S. Pat. No. 7,426,968. U.S. patent application Ser. No. 11/278,935 is a continuation-in-part of U.S. patent application Ser. No. 11/277,394 filed on Mar. 24, 2006 and now U.S. Pat. No. 7,398,837. U.S. patent application Ser. No. 11/277,394 is a continuation-in-part of U.S. patent application Ser. No. 11/277,380 also filed on Mar. 24, 2006 and now U.S. Pat. No. 7,337,858. U.S. patent application Ser. No. 11/277,380 is a continuation-in-part of U.S. patent application Ser. No. 11/306,976 filed on Jan. 18, 2006 and now U.S. Pat. No. 7,360,610. U.S. patent application Ser. No. 11/306,976 is a continuation-in-part of Ser. No. 11/306,307 filed on Dec. 22, 2005 and now U.S. Pat. No. 7,225,886. U.S. patent application Ser. No. 11/306,307 is a continuation-in-part of U.S. patent application Ser. No. 11/306,022 filed on Dec. 14, 2005 and now U.S. Pat. No. 7,198,119. U.S. patent application Ser. No. 11/306,022 is a continuation-in-part of U.S. patent application Ser. No. 11/164,391 filed on Nov. 21, 2005 and now U.S. Pat. No. 7,270,196. All of these applications are herein incorporated by reference in their entirety.

BACKGROUND OF THE INVENTION

This invention relates to drill bits, specifically drill bit assemblies for use in oil, gas and geothermal drilling. Drill bits are continuously exposed to harsh conditions during drilling operations in the earth's surface. Bit whirl in hard formations for example may result in damage to the drill bit and reduce penetration rates. Further loading too much weight on the drill bit when drilling through a hard formation may exceed the bit's capabilities and also result in damage. Too often unexpected hard formations are encountered suddenly and damage to the drill bit occurs before the weight on the drill bit may be adjusted. When a bit fails it reduces productivity resulting in diminished returns to a point where it may become uneconomical to continue drilling. The cost of the bit is not considered so much as the associated down time required to maintain or replace a worn or expired bit. To replace a bit requires removal of the drill string from the bore in order to service the bit which translates into significant economic losses until drilling can be resumed.

The prior art has addressed bit whirl and weight on bit issues. Such issues have been addressed in the U.S. Pat. No. 6,443,249 to Beuershausen, which is herein incorporated by reference for all that it contains. The '249 patent discloses a PDC-equipped rotary drag bit especially suitable for directional drilling. Cutter chamfer size and backrake angle, as well as cutter backrake, may be varied along the bit profile between the center of the bit and the gage to provide a less aggressive center and more aggressive outer region on the bit face, to enhance stability while maintaining side cutting capability, as well as providing a high rate of penetration under relatively high weight on bit.

U.S. Pat. No. 6,298,930 to Sinor which is herein incorporated by reference for all that it contains, discloses a rotary drag bit including exterior features to control the depth of cut by cutters mounted thereon, so as to control the volume of formation material cut per bit rotation as well as the torque experienced by the bit and an associated bottomhole assembly. The exterior features preferably precede, taken in the direction of bit rotation, cutters with which they are associated, and provide sufficient bearing area so as to support the bit against, the bottom of the borehole under weight on bit without exceeding the compressive strength of the formation rock.

U.S. Pat. No. 6,363,780 to Rey-Fabret which is herein incorporated by reference for all that it contains, discloses a system and method for generating an alarm relative to effective longitudinal behavior of a drill bit fastened to the end of a tool string driven in rotation in a well by a driving device situated at the surface, using a physical model of the drilling process based on general mechanics equations. The following steps are carried out: the model is reduced so to retain only pertinent modes, at least two values Rf and Rwob are calculated, Rf being a function of the principal oscillation frequency of weight on hook WOH divided by the average instantaneous rotating speed at the surface, Rwob being a function of the standard deviation of the signal of the weight on bit WOB estimated by the reduced longitudinal model from measurement of the signal of the weight on hook WOH, divided by the average weight on bit defined from the weight of the string and the average weight on hook. Any danger from the longitudinal behavior of the drill bit is determined from the values of Rf and Rwob.

U.S. Pat. No. 5,806,611 to Van Den Steen which is herein incorporated by reference for all that it contains, discloses a device for controlling weight on bit of a drilling assembly for drilling a borehole in an earth formation. The device includes a fluid passage for the drilling fluid flowing through the drilling assembly, and control means for controlling the flow resistance of drilling fluid in the passage in a manner that the flow resistance increases when the fluid pressure in the passage decreases and that the flow resistance decreases when the fluid pressure in the passage increases.

U.S. Pat. No. 5,864,058 to Chen which is herein incorporated by reference for all that is contains, discloses a down hole sensor sub in the lower end of a drillstring, such sub having three orthogonally positioned accelerometers for measuring vibration of a drilling component. The lateral acceleration is measured along either the X or Y axis and then analyzed in the frequency domain as to peak frequency and magnitude at such peak frequency. Backward whirling of the drilling component is indicated when the magnitude at the peak frequency exceeds a predetermined value. A low whirling frequency accompanied by a high acceleration magnitude based on empirically established values is associated with destructive vibration of the drilling component. One or more drilling parameters (weight on bit, rotary speed, etc.) is then altered to reduce or eliminate such destructive vibration.

BRIEF SUMMARY OF THE INVENTION

A drill bit comprising a bit body intermediate a shank and a working face comprising at least one cutting insert. A bore is formed in the working face co-axial within an axis of rotation of the drill bit. A jack element is retained within the bore by a retaining element that intrudes a diameter of the bore.

The jack element may comprise a polygonal or cylindrical shaft. A distal end may comprise a domed, rounded, semi-rounded, conical, flat, or pointed geometry. The shaft diameter may be 50 to 100% a diameter of the bore. The jack element may comprise a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

In some embodiments, the jack element may comprise a coating of abrasive resistant material comprised of a material selected from the following including natural diamond, polycrystalline diamond, boron nitride, tungsten carbide or combinations thereof. The coating of abrasion resistant material comprises a thickness of 0.5 to 4 mm.

The retaining element may be a cutting insert, a snap ring, a cap, a sleeve or combinations thereof. The retaining element may comprise a material selected from the group consisting of gold, silver, a refractory metal, carbide, tungsten carbide, cemented metal carbide, niobium, titanium, platinum, molybdenum, diamond, cobalt, nickel, iron, cubic boron nitride, and combinations thereof.

In some embodiments, the retaining element may intrude a diameter of the shaft. The retaining element may be disposed at a working surface of the drill bit. The retaining element may also be disposed within the bore. The retaining element may be complimentary to the jack element and the retaining element may have a bearing surface.

In some embodiments, the drill bit may comprise at least one electric motor. The at least one electric motor may be in mechanical communication with the shaft and may be adapted to axially displace the shaft.

The at least one electric motor may be powered by a turbine, a battery, or a power transmission system from the surface or down hole. The at least one electric motor may be in communication with a down hole telemetry system. The at least one electric motor may be an AC motor, a universal motor, a stepper motor, a three-phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof.

DETAILED DESCRIPTION OF THE INVENTION AND THE PREFERRED EMBODIMENT

Figure 1:
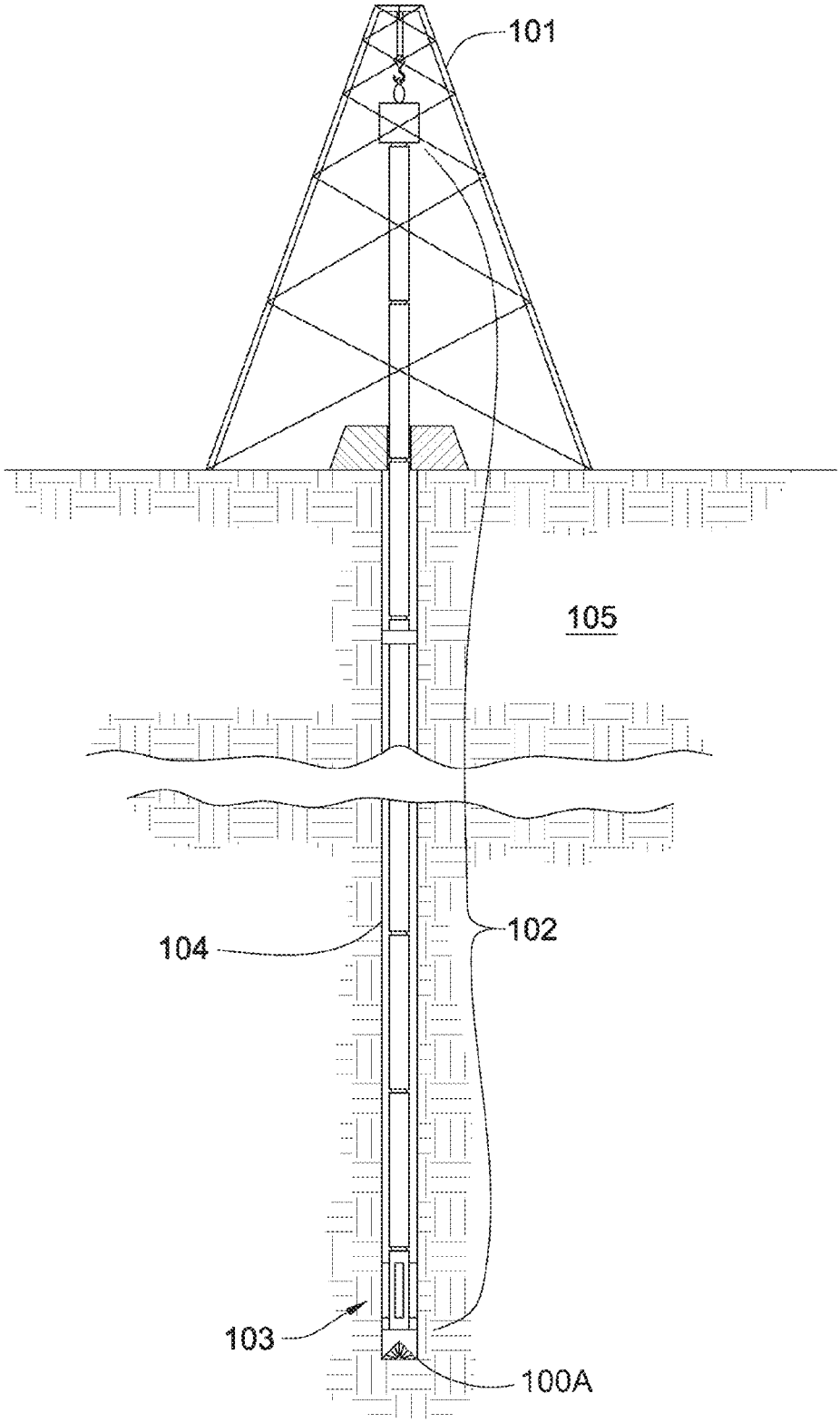
FIG. 1 is a cross-sectional view of an embodiment of a drill string suspended in a bore hole.

Referring now to the figures, FIG. 1 is a perspective diagram of an embodiment of a drill string 102 suspended by a derrick 101. A bottom-hole assembly 103 is located at the bottom of a bore hole 104 and includes a rotary drag bit 100A. As the rotary drag bit 100A rotates down-hole, the drill string 102 advances farther into the earth. The drill string 102 may penetrate soft or hard subterranean formations 105. The drill bit of the present invention is intended for deep oil and gas drilling, although any type of drilling application is anticipated such as horizontal drilling, geothermal drilling, mining, exploration, on and off-shore drilling, directional drilling, water well drilling and any combination thereof. The drill string 102 may be comprised of drill pipe, drill collars, heavy weight pipe, reamers, jars, and/or subs. In some embodiments coiled tubing or other types of tool string may be used.

Figure 2:
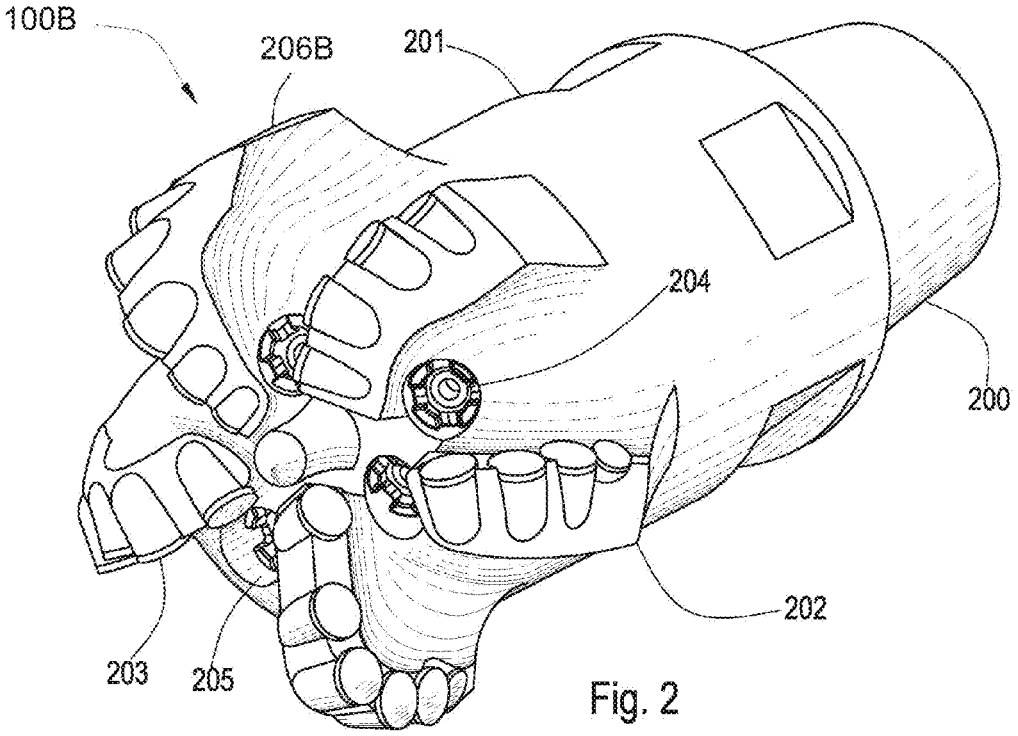
FIG. 2 is a perspective diagram of an embodiment of a drill bit.
Figure 3:
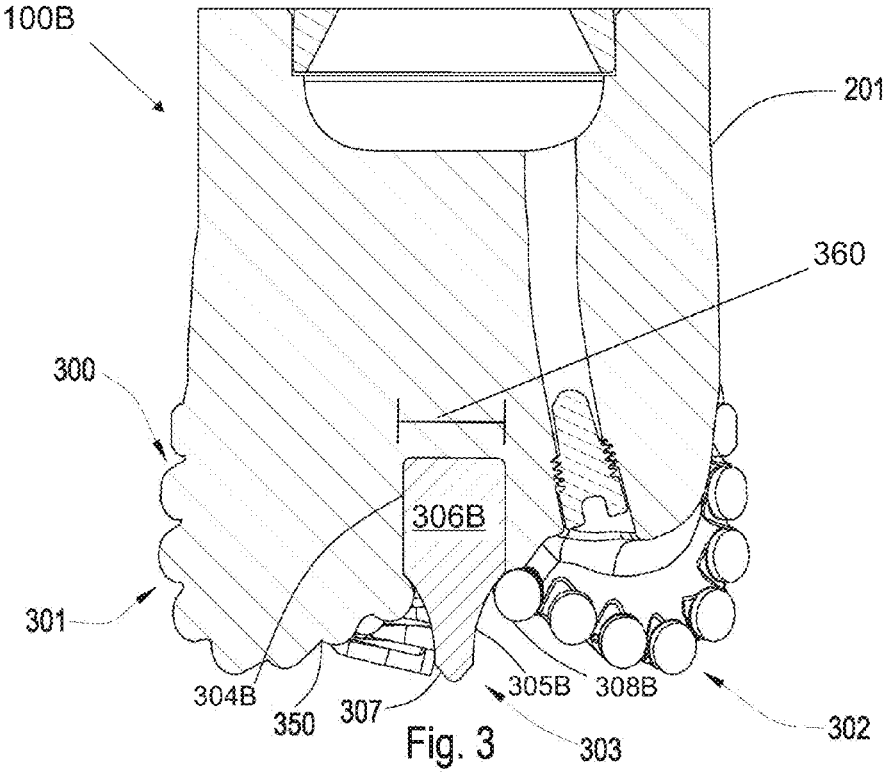
FIG. 3 is a cross-sectional diagram of an embodiment of a drill bit.

FIGS. 2 and 3 disclose an embodiment of a drill bit 100B of the present invention. The drill bit 100B comprises a shank 200 which is adapted for connection to a down hole tool string such as drill string 102 of FIG. 1. A bit body 201 is attached to the shank 200 and has an end which forms a working face 206B. Several blades 202 extend outwardly from the bit body 201, each of which may include a plurality of cutting inserts 203. A drill bit most suitable for the present invention may have at least three blades, and preferably the drill bit will have between three and seven blades 202.

The blades 202 collectively form an inverted conical region 303. Each blade 202 may have a cone portion 350, a nose portion 302, a flank portion 301, and a gauge portion 300. Cutting inserts 203 may be arrayed along any portion of the blades 202, including the cone portion 350, nose portion 302, flank portion 301, and gauge portion 300.

A plurality of nozzles 204 are fitted into recesses 205 formed in the working face 206B. Each nozzle 204 may be oriented such that a jet of drilling mud ejected from the nozzles 204 engages the formation 105 before or after the cutting inserts 203. The jets of drilling mud may also be used to clean cuttings away from the drill bit 100B. In some embodiments, the jets may be used to create a sucking effect to remove drill bit cuttings adjacent the cutting inserts 203 by creating a low pressure region within their vicinities.

One long standing problem in the industry is that cutting inserts chip or wear in hard formations when the drill bit is used too aggressively. To minimize cutting insert damage, the drillers will reduce the rotational speed of the bit, but all too often, a hard formation is encountered before it is detected and before the driller has time to react. A jack element 305B may limit the depth of cut that the drill bit 100B may achieve per rotation in a hard formation because the jack element 305B jacks the drill bit 100B thereby slowing its penetration in the unforeseen hard formations. If the formation is soft, the formation may not be able to resist the weight on bit (WOB) loaded to the jack element 305 and a minimal amount of jacking may take place. But in hard formations, the formation may be able to resist the jack element 305, thereby lifting the drill bit 100B as the cutting inserts 203 remove a volume of the formation during each rotation. As the drill bit 100B rotates and more volume is removed by the cutting inserts 203 and drilling mud, less WOB will be loaded to the cutting inserts 203 and more WOB will be loaded to the jack element 305B. Depending on the hardness of the formation, enough WOB will be focused immediately in front of the jack element 305B such that the hard formation will compressively fail, weakening the hardness of the formation and allowing the cutting inserts 203 to remove an increased volume with a minimal amount of damage.

The jack element 305B has a hard surface of at least 63 HRc. The hard surface may be attached to a distal end 307 of the jack element 305B, but it may also be attached to any portion of the jack element 305B. The jack element 305B may include a cylindrical shaft 306B which is adapted to fit within a bore 304B disposed in the working face 206B of the drill bit 100B. The jack element 305B may be retained in the bore 304B through the use of at least one retaining element 308B. The retaining element 308B may comprise a cutting insert 203, a snap ring, a cap, a sleeve or combinations thereof. The retaining element 308B retains the jack bit 305B in the bore 304B by the retaining element projecting into the bore 304B. FIGS. 2 through 3 disclose a drill bit 100B that utilizes at least one cutting insert 203 as a retaining element 308B to retain the jack element 305B within the bore 304B. At least one of the retaining elements 308B may project into the bore 304B a distance of 0.010 to 1 inch. In some embodiments, the at least one retaining element 308B may project into the bore B a distance of 0.300 to 0.700 inches into the bore 304B. In some embodiments, the retaining element may project into the bore 304B by a distance of within 5 to 35 percent of a diameter 360 of the bore 304B.

Still referring to FIG. 3, in one or more embodiments, the jack element 305 may extend from the bore 304 beyond the nose portion 302. In one or more embodiments, the jack element 305 may include a single distal end 307 that may extend beyond the nose portion 302.

Further, please add the following new paragraphs after the paragraph ending on line 5 on page 10 of the originally-filed specification. The following new paragraphs are taken from parent application Ser. No. 11/774,647, now U.S. Pat. No. 7,753,144, which were inadvertently left out of the pending application. Further, minor typographical errors appearing in the paragraphs taken from the parent application are corrected in the new paragraphs as shown below.

Figure 10:
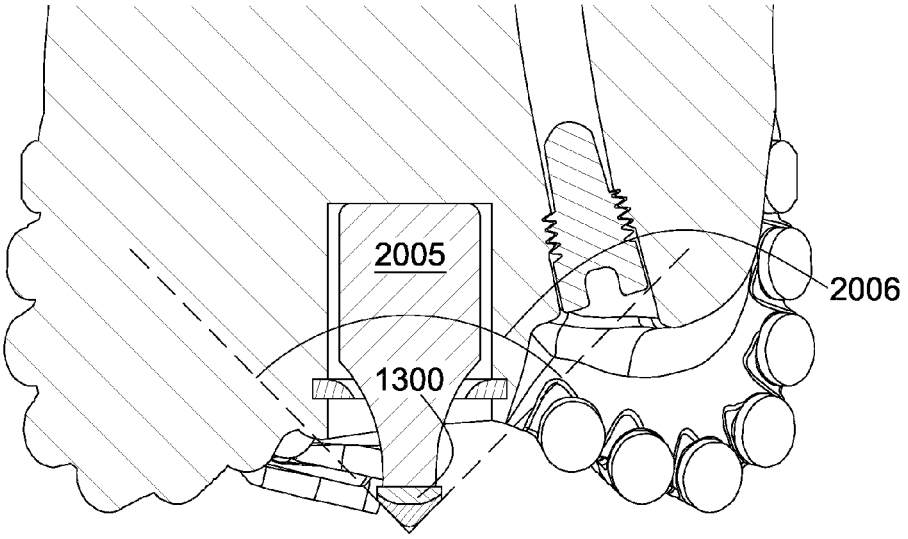
FIG. 10 is a cross-sectional diagram of another embodiment of a jack element.
Figure 11:
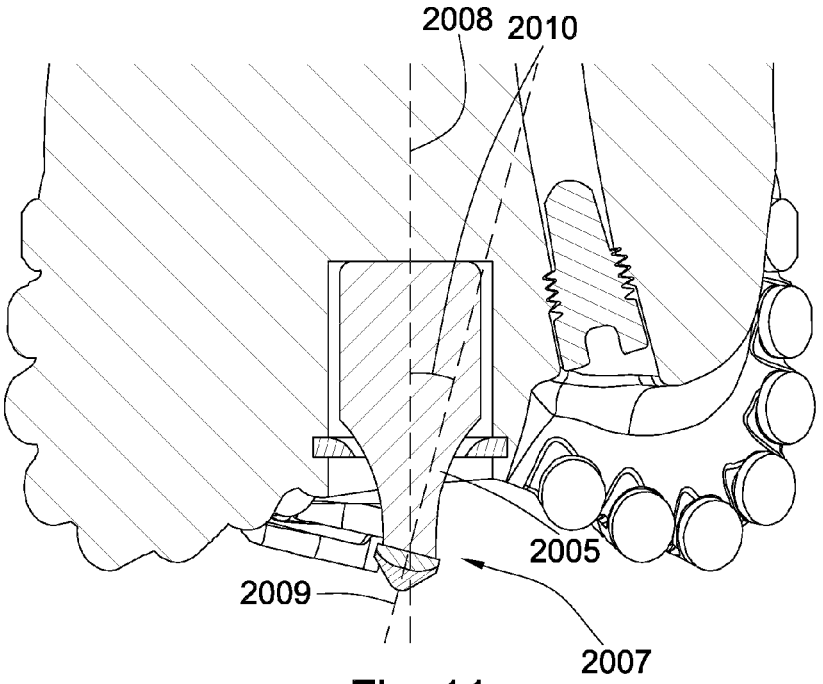
FIG. 11 is a cross-sectional diagram of another embodiment of a jack element.

FIG. 10 discloses a jack element with a substrate 1300 with a larger diameter than the shaft 2005. The pointed distal end may comprise an included angle 2006 between 40-50 degrees. FIG. 11 discloses a substrate 1300 which is brazed to an interface 2007 of the shaft 2005 which is non-perpendicular to a central axis 2008 of the shaft 2005, thus a central axis 2009 of the pointed distal end forms an angle 2010 of less than 10 degrees with the central axis 2008 of the shaft 2005. The off set distal end may be useful for steering the drill bit along curved trajectories.

Figure 12:
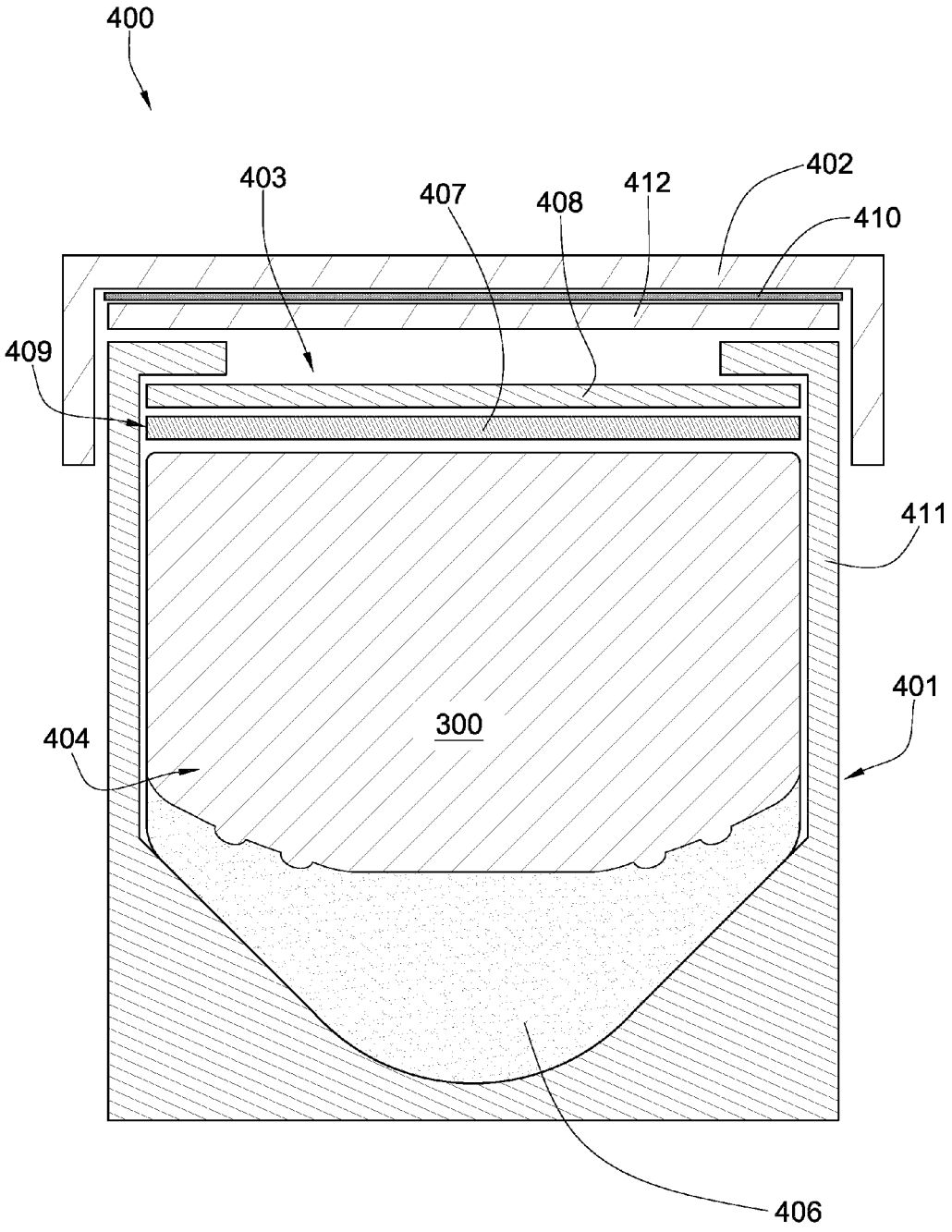
FIG. 12 is a cross-sectional diagram of an embodiment of an assembly for HPHT processing.

FIG. 12 is a cross-sectional diagram of an embodiment for a high pressure high temperature (HPHT) processing assembly 1400 comprising a can 1401 with a cap 1402. At least a portion of the can 1401 may comprise niobium, a niobium alloy, a niobium mixture, another suitable material, or combinations thereof. At least a portion of the cap 1402 may comprise a metal or metal alloy.

A can such as the can of FIG. 12 may be placed in a cube adapted to be placed in a chamber of a high temperature high pressure apparatus. Prior to placement in a high temperature high pressure chamber the assembly may be placed in a heated vacuum chamber to remove the impurities from the assembly. The chamber may be heated to 1000 degrees long enough to vent the impurities that may be bonded to superhard particles such as diamond which may be disposed within the can. The impurities may be oxides or other substances from the air that may readily bond with the superhard particles. After a reasonable venting time to ensure that the particles are clean, the temperature in the chamber may increase to melt a sealant 410 located within the can adjacent the lids 1412, 1408. As the temperature is lowered the sealant solidifies and seals the assembly. After the assembly has been sealed it may undergo HPHT processing producing a cutting element with an infiltrated diamond working end and a metal catalyst concentration of less than 5 percent by volume which may allow the surface of the diamond working end to be electrically insulating.

The assembly 1400 comprises a can 1401 with an opening 1403 and a substrate 1300 lying adjacent a plurality of super hard particles 1406 grain size of 1 to 100 microns. The super hard particles 1406 may be selected from the group consisting of diamond, polycrystalline diamond, thermally stable products, polycrystalline diamond depleted of its catalyst, polycrystalline diamond having nonmetallic catalyst, cubic boron nitride, cubic boron nitride depleted of its catalyst, or combinations thereof. The substrate 1300 may comprise a hard metal such as carbide, tungsten-carbide, or other cemented metal carbides. Preferably, the substrate 1300 comprises a hardness of at least 58 HRc.

A stop off 1407 may be placed within the opening 1403 of the can 1401 in-between the substrate 1300 and a first lid

1408. The stop off 1407 may comprise a material selected from the group consisting of a solder/braze stop, a mask, a tape, a plate, and sealant flow control, boron nitride, a non-wettable material or a combination thereof. In one embodiment the stop off 1407 may comprise a disk of material that corresponds with the opening of the can 1401. A gap 1409 between 0.005 to 0.050 inches may exist between the stop off 1407 and the can 1401. The gap 1409 may support the outflow of contamination while being small enough size to prevent the flow of a sealant 1410 into the mixture 1404. Various alterations of the current configuration may include but should not be limited to; applying a stop off 1407 to the first lid 1408 or can by coating, etching, brushing, dipping, spraying, silk screening painting, plating, baking, and chemical or physical vapor deposition techniques. The stop off 1407 may in one embodiment be placed on any part of the assembly 1400 where it may be desirable to inhibit the flow of the liquefied sealant 1410.

The first lid 1408 may comprise niobium or a niobium alloy to provide a substrate that allows good capillary movement of the sealant 1410. After the first lid 1408 is installed within the can, the walls 1411 of the can 1401 may be folded over the first lid 1408. A second lid 1412 may then be placed on top of the folded walls 1401. The second lid 1412 may comprise a material selected from the group consisting of a metal or metal alloy. The metal may provide a better bonding surface for the sealant 1410 and allow for a strong bond between the lids 1408, 1412, can 1401 and a cap 1402. Following the second lid 1412 a metal or metal alloy cap 1402 may be placed on the can 1401.

Figure 13:
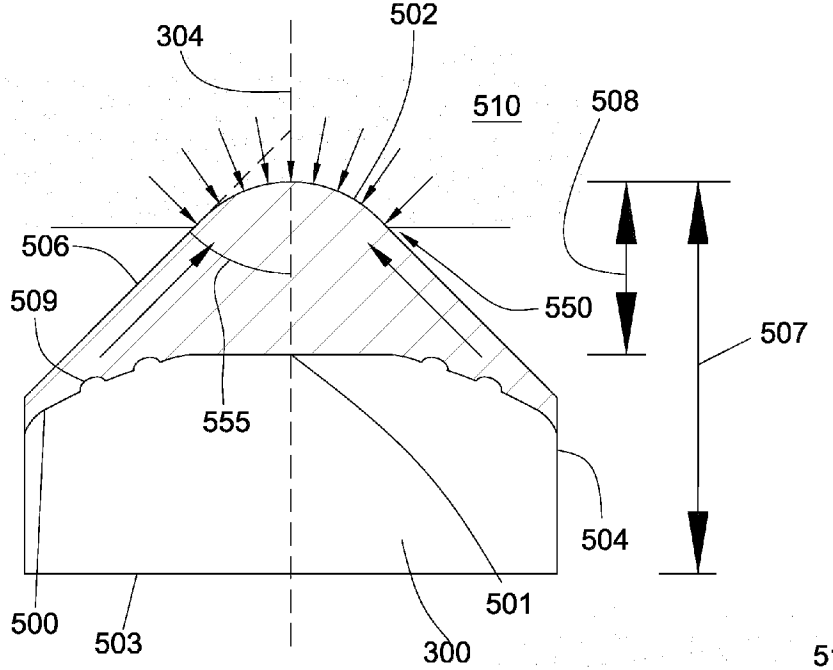
FIG. 13 is a cross-sectional diagram of another embodiment of a cutting element

Now referring to FIG. 13, the substrate 1300 comprises a tapered surface 1500 starting from a cylindrical rim 1504 of the substrate and ending at an elevated, flatted, central region 1501 formed in the substrate. The diamond working end 1506 comprises a substantially pointed geometry 1700 with a sharp apex 1502 comprising a radius of 0.050 to 0.125 inches. In some embodiments, the radius may be 0.900 to 0.110 inches. It is believed that the apex 1502 is adapted to distribute impact forces across the flatted region 1501, which may help prevent the diamond working end 1506 from chipping or breaking. The diamond working end 1506 may comprise a thickness 1508 of 0.100 to 0.500 inches from the apex to the flatted region 1501 or non-planar interface, preferably from 0.125 to 0.275 inches. The diamond working end 1506 and the substrate 1300 may comprise a total thickness 1507 of 0.200 to 0.700 inches from the apex 1502 to a base 1503 of the substrate 1300. The sharp apex 1502 may allow the drill bit to more easily cleave rock or other formations.

The pointed geometry 1700 of the diamond working end 1506 may comprise a side which forms a 35 to 55 degree angle 1555 with a central axis 1304 of the cutting element 208, though the angle 1555 may preferably be substantially 45 degrees. The included angle may be a 90 degree angle, although in some embodiments, the included angle is 85 to 95 degrees.

The pointed geometry 1700 may also comprise a convex side or a concave side. The tapered surface of the substrate may incorporate nodules 1509 at the interface between the diamond working end 1506 and the substrate 1300, which may provide more surface area on the substrate 1300 to provide a stronger interface. The tapered surface may also incorporate grooves, dimples, protrusions, reverse dimples, or combinations thereof. The tapered surface may be convex, as in the current embodiment, though the tapered surface may be concave.

Figure 14:
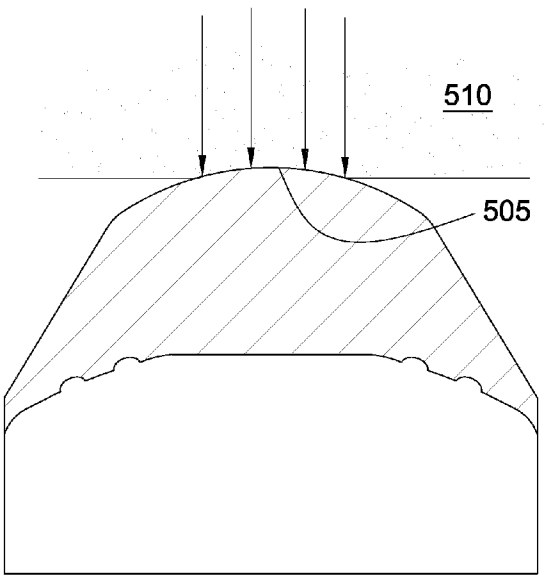
FIG. 14 is a cross-sectional diagram of another embodiment of a cutting element.

Comparing FIGS. 13 and 14, the advantages of having a pointed apex 1502 as opposed to a blunt apex 1505 may be seen. FIG. 13 is a representation of a pointed geometry 1700 which was made by the inventors of the present invention, which has a 0.094 inch radius apex and a 0.150 inch thickness from the apex to the non-planar interface. FIG. 5*b* is a representation of another geometry also made by the same inventors comprising a 0.160 inch radius apex and 0.200 inch thickness from the apex to the non-planar geometry. The cutting elements were compared to each other in a drop test performed at Novatek International, Inc. located in Provo, Utah. Using an Instron Dynatup 9250G drop test machine, the cutting elements were secured in a recess in the base of the machine burying the substrate 1300 portions of the cutting elements and leaving the diamond working ends 1506 exposed. The base of the machine was reinforced from beneath with a solid steel pillar to make the structure more rigid so that most of the impact force was felt in the diamond working end 1506 rather than being dampened. The target 1510 comprising tungsten carbide 16% cobalt grade mounted in steel backed by a 19 kilogram weight was raised to the needed height required to generate the desired potential force, then dropped normally onto the cutting element. Each cutting element was tested at a starting 5 joules, if the elements withstood joules they were retested with a new carbide target 1510 at an increased increment of 10 joules the cutting element failed. The pointed apex 11502 of FIG. 13 surprisingly required about 5 times more joules to break than the thicker geometry of FIG. 14.

It is believed that the sharper geometry of FIG. 13 penetrated deeper into the tungsten carbide target 1510, thereby allowing more surface area of the diamond working ends 1506 to absorb the energy from the falling target by beneficially buttressing the penetrated portion of the diamond working ends 1506 effectively converting bending and shear loading of the substrate into a more beneficial compressive force drastically increasing the load carrying capabilities of the diamond working ends 1506. On the other hand it is believed that since the embodiment of FIG. 14 is blunter the apex hardly penetrated into the tungsten carbide target 1510 thereby providing little buttress support to the substrate and caused the diamond working ends 1506 to fail in shear/bending at a much lower load with larger surface area using the same grade of diamond and carbide. The average embodiment of FIG. 13 broke at about 130 joules while the average geometry of FIG. 14 broke at about 24 joules. It is believed that since the load was distributed across a greater surface area in the embodiment of FIG. 13 it was capable of withstanding a greater impact than that of the thicker embodiment of FIG. 14.

Surprisingly, in the embodiment of FIG. 13, when the super hard geometry 1700 finally broke, the crack initiation point 1550 was below the radius of the apex. This is believed to result from the tungsten carbide target pressurizing the flanks of the pointed geometry 1700 (number not shown in the FIG.) in the penetrated portion, which results in the greater hydrostatic stress loading in the pointed geometry 1700. It is also believed that since the radius was still intact after the break, that the pointed geometry 1700 will still be able to withstand high amounts of impact, thereby prolonging the useful life of the pointed geometry 1700 even after chipping.

Figure 15:
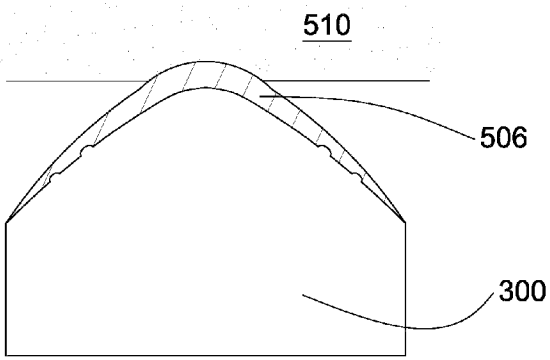
FIG. 15 is a cross-sectional diagram of another embodiment of a cutting element.
Figure 16:
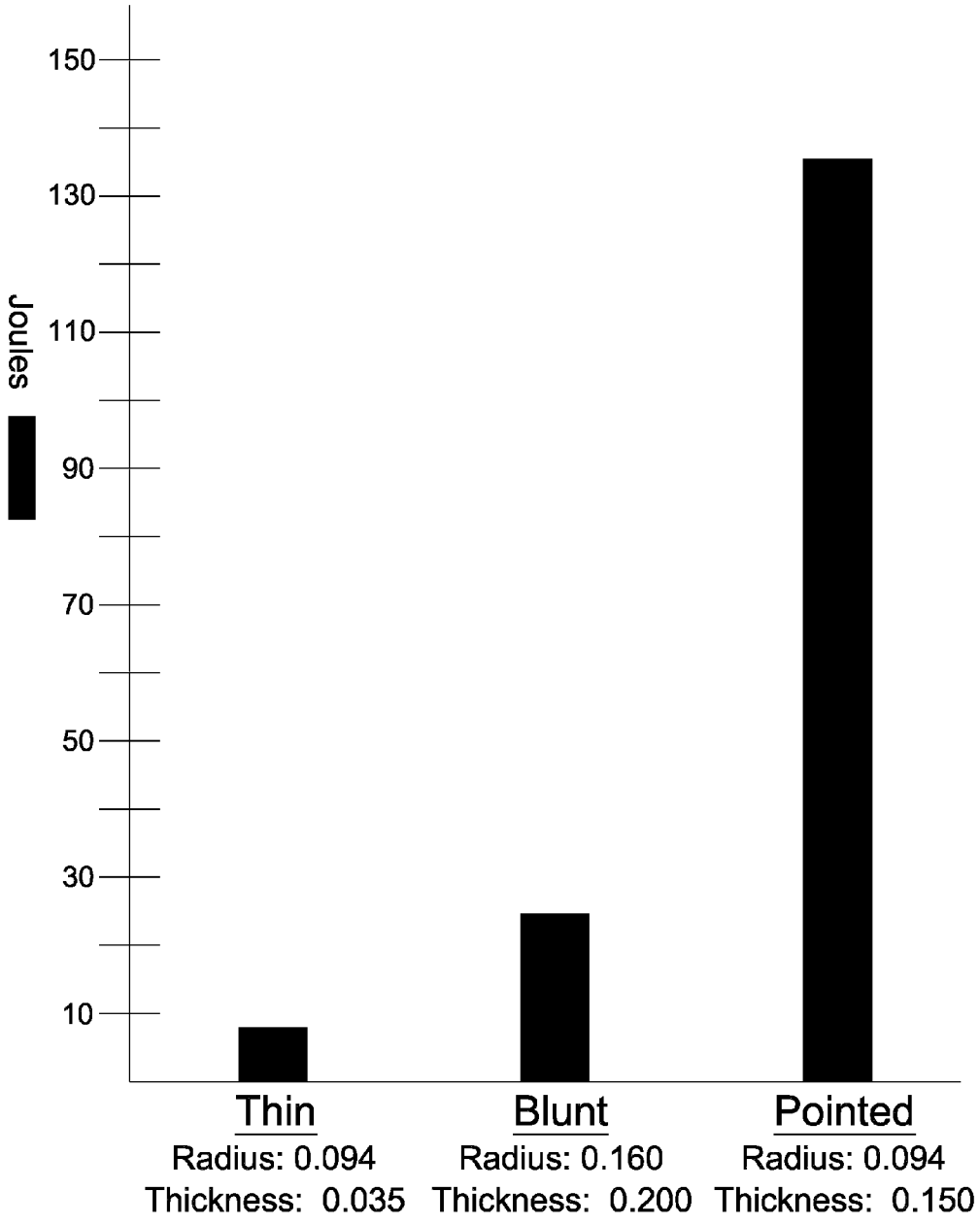
FIG. 16 is a diagram of an embodiment of test results.

FIG. 16 illustrates the results of the tests performed by Novatek, International, Inc. As can be seen, three different types of pointed insert geometries were tested. This first type of geometry is disclosed in FIG. 15 which comprises a 0.035 inch super hard geometry and an apex with a 0.094 inch radius. This type of geometry broke in the 8 to 15 joules range. The blunt geometry with the radius of 0.160 inches and a thickness of 0.200, which the inventors believed would outperform the other geometries broke, in the 20-25 joule range. The pointed geometry 1700 with the 0.094 thickness and the 0.150 inch thickness broke at about 13 joules. The impact force measured when the super hard geometry with the 0.160 inch radius broke was 75 kilo-newtons. Although the Instron drop test machine was only calibrated to measure up to 88 kilo-newtons, which the pointed geometry 700 exceeded when it broke, the inventors were able to extrapolate that the pointed geometry 700 probably experienced about 105 kilo-newtons when it broke.

As can be seen, super hard material 1506 having the feature of being thicker than 0.100 inches or having the feature of a 0.075 to 0.125 inch radius is not enough to achieve the diamond working end's 1506 optimal impact resistance, but it is synergistic to combine these two features. In the prior art, it was believed that a sharp radius of 0.075 to 0.125 inches of a super hard material such as diamond would break if the apex were too sharp, thus rounded and semispherical geometries are commercially used today.

Figure 17D:
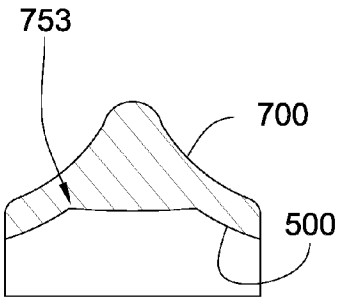
FIG. 17*d* is a cross-sectional diagram of another embodiment of a cutting element.
Figure 17C:
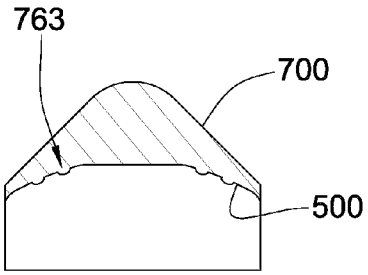
FIG. 17*c* is a cross-sectional diagram of another embodiment of a cutting element.
Figure 17B:
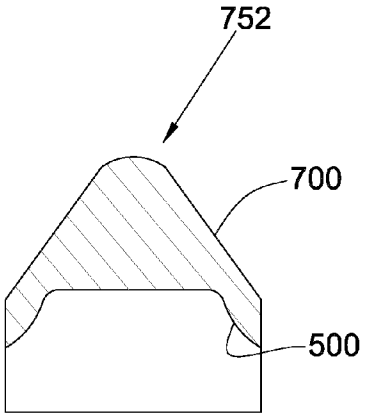
FIG. 17*b* is a cross-sectional diagram of another embodiment of a cutting element.
Figure 17A:
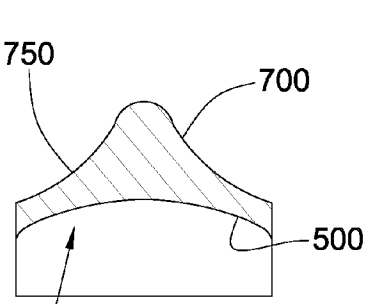
FIG. 17*a* is a cross-sectional diagram of another embodiment of a cutting element.

The performance of the present invention is not presently found in commercially available products or in the prior art. Inserts tested between 5 and 20 joules have been acceptable in most commercial applications, but not suitable for drilling very hard rock formations FIGS. 17*a* through 17*g* disclose various possible embodiments comprising different combinations of tapered surface 1500 and pointed geometries 1700. FIG. 17*a* illustrates the pointed geometry with a concave side 1750 and a continuous convex substrate geometry 1751 at the interface 1500. FIG. 17*b* comprises an embodiment of a thicker super hard material 1752 from the apex to the non-planar interface, while still maintaining this radius of 0.075 to 0.125 inches at the apex. FIG. 17*c* illustrates grooves 1763 formed in the substrate to increase the strength of interface. FIG. 17*d* illustrates a slightly concave geometry at the interface 1753 with concave sides. FIG. 17*e* discloses slightly convex sides 1754 of the pointed geometry 1700 while still maintaining the 0.075 to 0.125 inch radius. FIG. 17*f* discloses a flat sided pointed geometry 1755. FIG. 17*g* discloses concave and convex portions 1757, 1756 of the substrate with a generally flatted central portion.

Figure 17H:
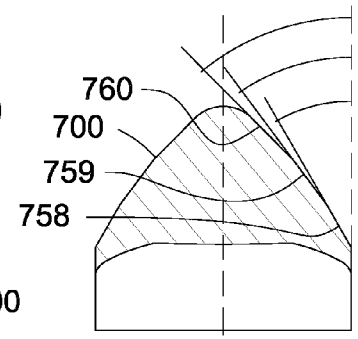
FIG. 17*h* is a cross-sectional diagram of another embodiment of a cutting element.
Figure 17G:
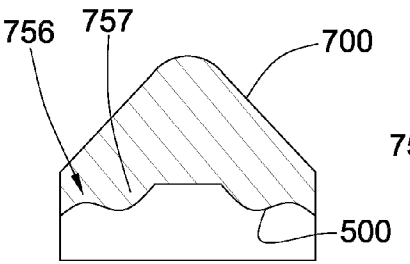
FIG. 17*g* is a cross-sectional diagram of another embodiment of a cutting element.
Figure 17F:
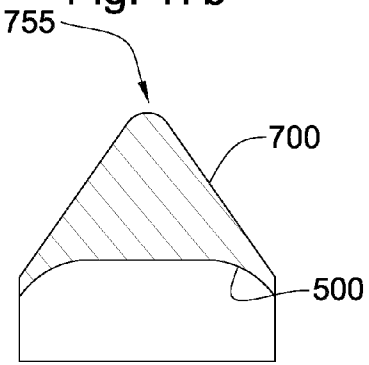
FIG. 17*f* is a cross-sectional diagram of another embodiment of a cutting element.
Figure 17E:
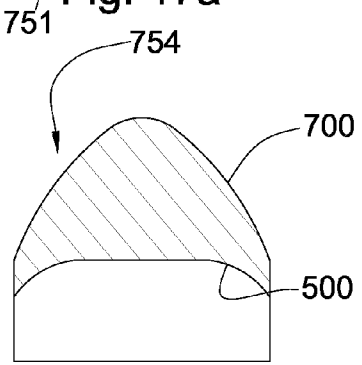
FIG. 17*e* is a cross-sectional diagram of another embodiment of a cutting element.
Figure 18:
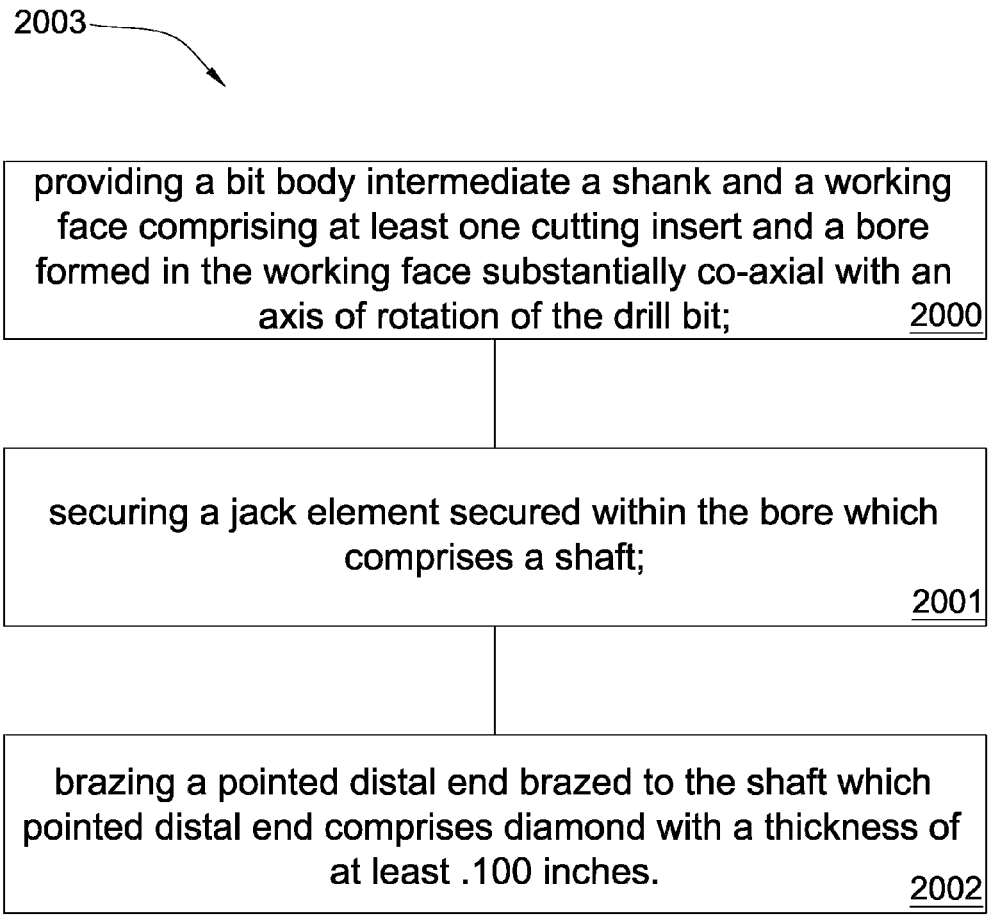
FIG. 18 is a diagram of an embodiment of a method for making a drill bit.

Now referring to FIG. 17*h*, the diamond working end 1506 (number not shown in the FIG.) may comprise a convex surface comprising different general angles at a lower portion 1758, a middle portion 1759, and an upper portion 1760 with respect to the central axis of the tool. The lower portion 1758 of the side surface may be angled at substantially 25 to 33 degrees from the central axis, the middle portion 1759, which may make up a majority of the convex surface, may be angled at substantially 33 to 40 degrees from the central axis, and the upper portion 1760 of the side surface may be angled at about 40 to 50 degrees from the central axis.

In another aspect of the invention, a method 2003 for making a drill bit may include providing 2000 a bit body intermediate a shank and a working face comprising at least one cutting insert and a bore formed in the working face substantially co-axial with an axis of rotation of the drill bit; securing 2001 a jack element secured within the bore which comprises a shaft; and brazing 2002 a pointed distal end brazed to the shaft which pointed distal end comprises diamond with a thickness of at least 0.100 inches. In some embodiments, a region of the substrate adjacent the braze may be ground to reduce or eliminate any cracks that may have been formed during manufacturing or brazing. In some embodiments, the substrate may be brazed to the shaft while the shaft is being brazed within the bore.

In some embodiments, the jack element 305B is made of the material of at least 63 HRc. In the preferred embodiment, the jack element 305B is made of a tungsten carbide with polycrystalline diamond bonded to its distal end 307. In some embodiments, the distal end 307 of the jack element 305B is a diamond or cubic boron nitride surface. The diamond may be selected from group consisting of polycrystalline diamond, natural diamond, synthetic diamond, vapor deposited diamond, silicon bonded diamond, cobalt bonded diamond, thermally stable diamond, polycrystalline diamond with a cobalt concentration of 1 to 40 weight percent, infiltrated diamond, layered diamond, polished diamond, course diamond, fine diamond or combinations thereof. In some embodiments, the jack element 305B is made primarily from a cemented carbide with a binder concentration of 1 to 40 weight percent, preferably of cobalt.

In some embodiments the bit body 201 is made of steel or a matrix. The working face 206B of the drill bit 100B may be made of a steel, a matrix, or a carbide. The cutting inserts 203 or distal end 307 of the jack element 305B may also be made out of hardened steel or may have a coating of chromium, titanium, aluminum or combinations thereof.

Figure 4:
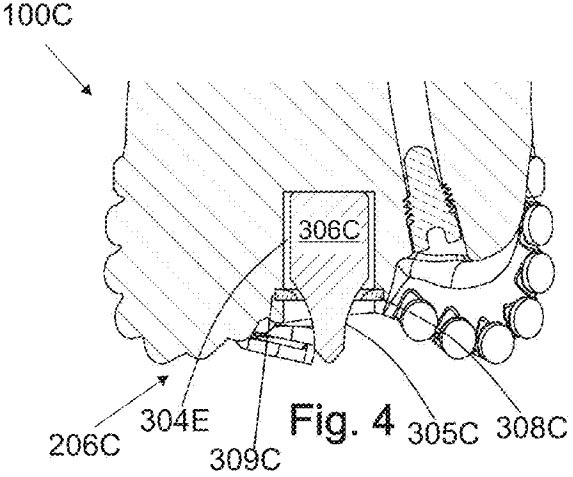
FIG. 4 is a cross-sectional diagram of another embodiment of a drill bit.

FIG. 4 discloses an embodiment of a drill bit 100C with a bore 304C disposed in the a working face 206C of the drill bit 100C. A shaft 306C of the jack element 305C is disposed within the bore 304C. At least one recess 309C has been formed in a surface of the bore 304C such that a snap ring 308C may be placed within the bore 304C retaining the shaft 306C within the bore 304C.

Figure 5:
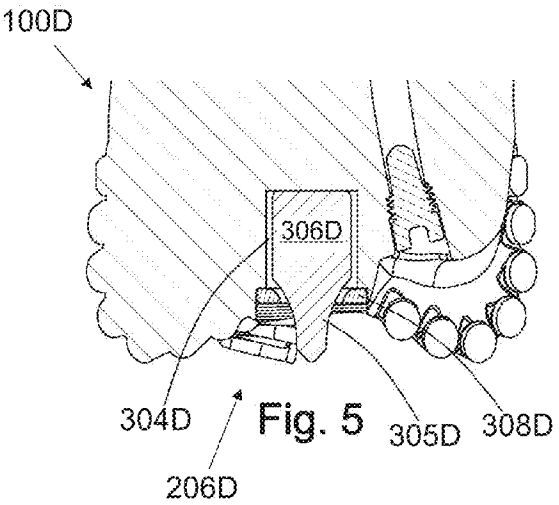
FIG. 5 is a cross-sectional diagram of another embodiment of a drill bit.

FIG. 5 discloses an embodiment of a drill bit 100D in which a jack element 305D is retained in a bore 304D disposed in a working face 206D of the drill bit 100D by a cap retaining element 308D. The cap retaining element 308D may be threaded, brazed, bolted, riveted or press-fitted to the working surface 206D of the drill bit 100D. The surface of the cap retaining element 308D may be complimentary to the jack element 305D. The cap retaining element 308D may also have a bearing surface.

Figure 6:
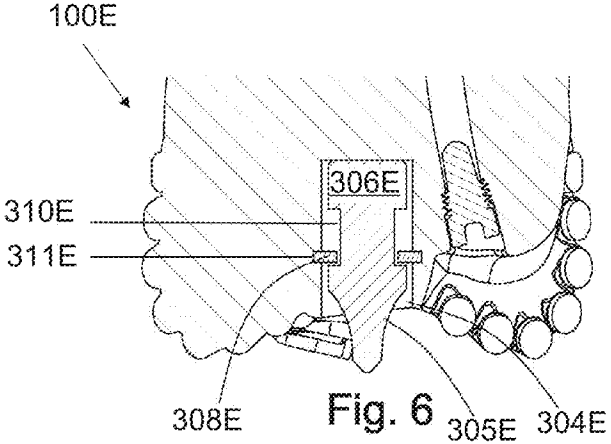
FIG. 6 is a cross-sectional diagram of another embodiment of a drill bit.

Now referring to the embodiment of a drill bit 100E of FIG. 6, a shaft 306E may have at least one recess 310E to accommodate the reception of a retaining element 308E. The retaining element 308E is a snap ring that retains the jack bit 305E in the bore 304E by expanding into a recess 311E formed in the bore 304E and into the recess 310E formed in the shaft 306E.

Figure 7:
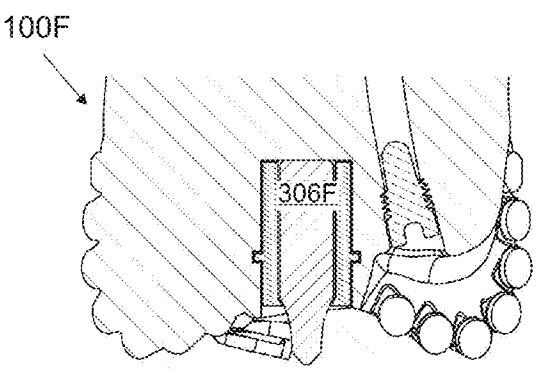
FIG. 7 is a cross-sectional diagram of another embodiment of a drill bit.

In the embodiment of a drill bit 100F of FIG. 7, a sleeve 308F may be used as a retaining element as disclosed in FIG. 7.

Figure 8:
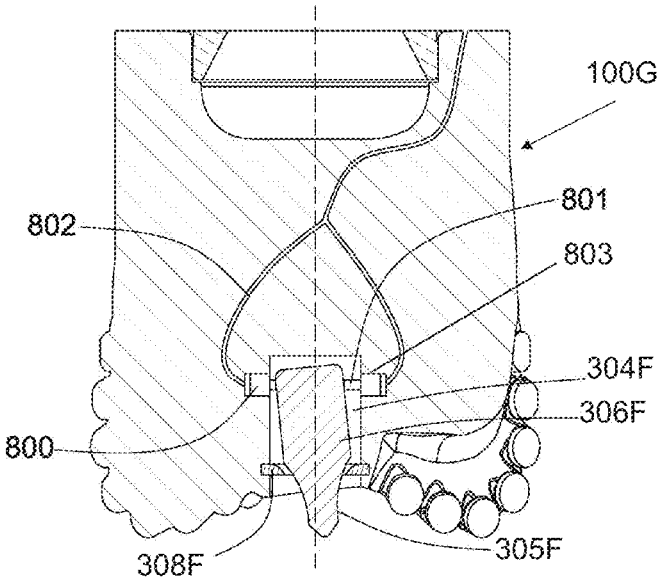
FIG. 8 is a cross-sectional diagram of another embodiment of a drill bit.
Figure 9:
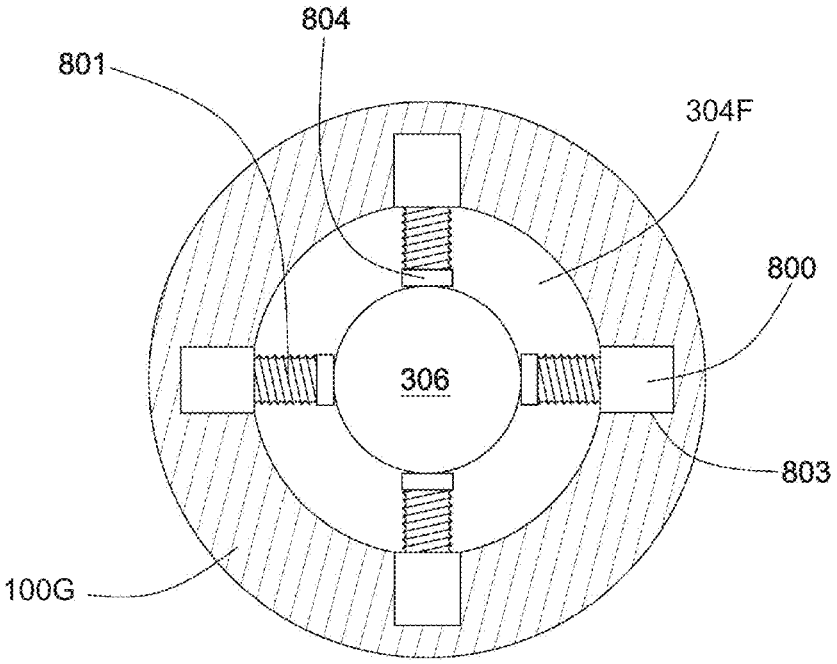
FIG. 9 is a cross-sectional diagram of an embodiment of a steering mechanism.

In the embodiment of FIG. 8 and FIG. 9, a drill bit 100G may include a plurality of electric motors 800 adapted to alter a axial orientation of a shaft 306F of a lack element 305F. The motors 800 may be disposed within recesses 803 formed within a bore 304F wall. The motors may also be disposed within a collar support (not shown) secured to the bore 304F wall. The plurality of electric motors 800 may include an AC motor, a universal motor, a stepper motor, a three phase AC induction motor, a three-phase AC synchronous motor, a two-phase AC servo motor, a single-phase AC induction motor, a single-phase AC synchronous motor, a torque motor, a permanent magnet motor, a DC motor, a brushless DC motor, a coreless DC motor, a linear motor, a doubly- or singly-fed motor, or combinations thereof.

Each electric motor 800 may include a protruding threaded pin 801 which extends or retracts according to the rotation of the motor 800. The threaded pin 801 may include an end element 804 such that the shaft 306F is axially fixed when all of the end elements 804 are contacting the shaft 306F. The axial orientation of the shaft 306F may be altered by extending the threaded pin 801 of one of the motors 800 and retracting the threaded pin 801 of the other motors 800. Altering the axial orientation of the shaft 306F may aid in steering the tool string (not shown).

The electric motors 800 may be powered by a turbine, a battery, or a power transmission system from the surface or down hole. The electric motors 800 may also be in communication 802 with a downhole telemetry system.

Whereas the present invention has been described in particular relation to the drawings attached hereto, it should be understood that other and further modifications apart from those shown or suggested herein, may be made within the scope and spirit of the present invention.

What is claimed is:

1. A drill bit comprising;

a shank adapted for connection to a downhole tool string;

a bit body coupled to said shank, said bit body having a bit body central axis and a working face with at least one blade having a nose portion;

a bore formed in said working face, said bore having a bore central axis and a bore radius, wherein said bore central axis and said bit body central axis are co-axial;

a jack element disposed in said bore and configured to engage a formation, said jack element having a jack element central axis coaxial with said bit body central axis and a single distal end; and a retaining element disposed proximate said bore, said retaining element being positioned such that a distance from said bore central axis to said retaining element is less than said bore radius, wherein the retaining element is a tubular sleeve having a protrusion integrally formed thereon, the protrusion extending directly into the bit body, and the retaining element secured around an outer surface of the jack element and retains the jack element.

2. The drill bit of claim 1, wherein a length of the retaining element is substantially equal to a depth of the bore formed in the working face.

3. A drill bit comprising;

a shank adapted for connection to a downhole tool string;

a bit body coupled to said shank, said bit body having a bit body central axis and a working face with at least one blade having a nose portion;

a bore formed in said working face, said bore having a bore central axis co-axial with said bit body central axis;

a retaining element disposed proximate said bore; and a jack element disposed in said bore, said jack element retained within said bore by said retaining element, said jack element extending from said bore and comprising:

a cylindrical shaft having a central axis defined therethrough; and a distal end formed centrally on an end of the cylindrical shaft, the distal end extending beyond said nose portion, wherein the central axis of the cylindrical shaft of the jack element is coaxial with the bit body central axis, wherein the retaining element is a tubular sleeve having a hollow, cylindrical body with an opening formed centrally therethrough, the retaining element secured around an outer surface of the jack element and retains the jack element, wherein said retaining element is at least partially attached to said working face of said drill bit.

4. The drill bit of claim 3 wherein said retaining element projects into said bore to retain said jack element.

5. The drill bit of claim 4, wherein said jack element has a polygonal shaft.

6. The drill bit of claim 3, wherein said retaining element is formed of a material selected from the group consisting of gold, silver, a refractory metal, carbide, tungsten carbide, cemented metal carbide, niobium, titanium, platinum, molybdenum, diamond, cobalt, nickel, iron, and cubic boron nitride.

7. The drill bit of claim 3, wherein said retaining element is disposed within said bore.

8. The drill bit of claim 3, wherein said retaining element is complementary to said jack element.

9. The drill bit of claim 3, wherein said retaining element has a bearing surface.

10. The drill bit of claim 3, wherein said jack element is formed of a material selected from the group consisting of a refractory metal, carbide, tungsten carbide, cemented metal carbide, niobium, titanium, platinum, molybdenum, diamond, cobalt, nickel, iron, and cubic boron nitride.

11. The drill bit of claim 3, wherein said jack element has a coating of abrasive resistant material formed of a material selected from the group consisting of natural diamond, polycrystalline diamond, boron nitride, and tungsten carbide.

12. The drill bit of claim 3, wherein said jack element has a shaft disposed in said bore, wherein a diameter of said shaft is 50% to 100% of a diameter of the bore.

13. The drill bit of claim 3, wherein said drill bit further includes at least one electric motor in mechanical communication with and adapted to displace said jack element so that said jack element central axis is no longer substantially coaxial with said bit body central axis.

14. The drill bit of claim 3, wherein a thickness of the sleeve defined by a distance between an inner diameter of the sleeve and an outer diameter of the sleeve is less than the outer diameter of the jack element.

15. A drill bit comprising;

a shank adapted for connection to a downhole tool string;

a bit body coupled to said shank, said bit body having a bit body central axis and a working face with at least one blade having a nose portion;

a bore formed in said working face, said bore having a bore central axis and a bore radius, wherein said bore central axis and said bit body central axis are co-axial;

a jack element disposed in said bore and configured to engage a formation, said jack element having a jack element central axis coaxial with said bit body central axis and a single distal end; and a retaining element disposed proximate said bore, said retaining element being positioned such that a distance from said bore central axis to said retaining element is less than said bore radius, wherein the retaining element is a sleeve secured around an outer surface of the jack element and retains the jack element, and wherein the retaining element comprises a protrusion integrally formed thereon, and the retaining element contacts both the jack element and the bit body.

* * * * *